US005780193A

United States Patent [19]

Suzuki et al.

[11] Patent Number: 5,780,193

[45] Date of Patent: Jul. 14, 1998

[54] ELECTROPHOTOGRAPHIC PHOTOCONDUCTOR WITH CONDUCTIVE BORON POLYMER

[75] Inventors: Shinjiro Suzuki; Sumitaka Nogami, both of Nagano, Japan

[73] Assignee: Fuji Electric Co., Ltd., Japan

[21] Appl. No.: 909,519

[22] Filed: Aug. 12, 1997

[30] Foreign Application Priority Data

Aug. 13, 1996 [JP] Japan ..... 8-213355

[51] Int. Cl.[6] ..... G03G 5/14

[52] U.S. Cl. ..... 430/62; 430/58; 430/63

[58] Field of Search ..... 430/62, 63

[56] References Cited

U.S. PATENT DOCUMENTS 5,110,669 5/1992 Knobel et al. ..... 252/500

5,296,568 3/1994 Chen et al. ..... 525/431

5,326,635 7/1994 Koyama ..... 428/323

5,340,676 8/1994 Anderson et al. ..... 430/63

FOREIGN PATENT DOCUMENTS 57-150851 9/1982 Japan ..... 430/63

*Primary Examiner*—Roland Martin

*Attorney, Agent, or Firm*—Rossi & Associates

[57] ABSTRACT

In an electrophotographic photoconductor wherein an intermediate layer and a photosensitive layer are successively formed on a conductive substrate, a conductive boron polymer is used for forming the intermediate layer.

3 Claims, 1 Drawing Sheet

ELECTROPHOTOGRAPHIC PHOTOCONDUCTOR WITH CONDUCTIVE BORON POLYMER

FIELD OF THE INVENTION

The present invention generally relates to an electrophotographic photoconductor, and in particular to an intermediate layer of the electrophotographic photoconductor that ensures stable printing density and high image quality.

BACKGROUND OF THE INVENTION

To produce electrophotographic photoconductors used in electrophotographic apparatus, such as copying machines, printers, and facsimile machines, based on the Carlson method, inorganic photoconductors or photoconductive materials, such as selenium, selenium alloy, zinc oxide, and cadmium sulfide, have been conventionally used in many applications. In recent years, photoconductors using organic photonductive materials have been extensively developed, taking advantage of their pollution-free characteristics, film-forming characteristics and light weight. In particular, the main stream of the photoconductors are so-called function-separated type organic photoconductors having a charge generation layer and a charge transport layer separately, which is advantageous in that each layer is formed of a material that optimally serves its function, to significantly improve the light-sensitivity, and in that the spectral sensitivity of the photoconductor can be determined depending upon a wavelength of light used for exposure.

In many of the currently available function-separated type electrophotographic organic photoconductors, the charge generation layer and charge transport layer are laminated in this order on a conductive substrate. To produce this type of photoconductor, a charge generating material and a binder are dispersed and dissolved in an organic solvent to prepare a coating liquid, which is then applied by coating to the substrate and dried, to thus form the charge generation layer. Subsequently, a charge transport material and a binder are dissolved in an organic solvent, to prepare a coating liquid, which is then applied by coating to the charge generation layer and dried, to thus form the charge transport layer.

The photoconductor thus produced by laminating the charge generation layer and charge transport layer directly on the substrate performs basic functions as a photoconductor, but suffers from the following problem. Namely, the charger generation layer is generally formed as an extremely thin layer having a thickness of 0.5 μm or smaller, so that charge carriers produced by the charge generation layer when absorbing light are rapidly injected into the substrate and the charge transport layer. If the substrate has flaws, soil, deposits or the like on its surface, therefore, the charge generation layer formed on the substrate suffers from defects, such as pinholes or unevenness of the film, which tend to cause problems in images to be produced, including, for example, black dots on the images and variations in the density. Further, the charge injection between the substrate and the charge generation layer is not sufficiently prevented, and therefore the charge retention of the photoconductor is lowered by holes injected from the substrate, often resulting in fogs on white papers.

To eliminate such image defects due to the film unevenness of the charge generation layer and injection of holes from the substrate, an intermediate layer is provided between the conductive substrate and a photosensitive layer consisting of the charge generation layer and charge transport layer.

Known resins used for forming the intermediate layer include solvent-soluble polyamide, polyvinyl alcohol, polyvinyl butyral and casein. An intermediate layer employing these resins can satisfactorily fulfill its function even if it is a considerably thin film having a thickness of 0.1 μm or less. This layer, however, needs to be formed with a film thickness of 0.5 μm or larger so as to cover the defects or dirt on the surface of the conductive substrate, and eliminate the film unevenness of the charge generation layer. In some cases, the intermediate layer may be required to have a thickness of 1 μm or larger, depending upon the surface roughness or contamination of the substrate.

If the intermediate layer is formed as a thick resin film having a thickness of 1 μm or larger, however, the carriers produced in the charge generation layer are less likely to be injected into the substrate, and residual potential tends to increase in repetitive use, thus causing image defects, such as reduced printing density. Also, electric characteristics of the intermediate layer are significantly varied due to influences of changes in the environment in which the photoconductor is used, thereby causing problems, such as fogging on white portions of the images. More specifically, in a high-temperature, high-humidity environment, ionic conduction occurs in the intermediate layer, which is caused by hydrogen ions or hydroxy ions dissociated due to moisture absorption of the intermediate layer, and the electric resistance of the resin layer (intermediate layer) is largely lowered. For the opposite reason, the electric resistance of the intermediate layer is increased in a low-temperature, low-humidity environment.

In view of the above situation, various resins have been proposed to form an intermediate layer which has relatively low electric resistance even with a larger thickness than the conventional one, and experiences only small variations in the electric resistance with respect to changes in the ambient environment. These resins may include solvent-soluble polyamide resins whose chemical structures are specified in Japanese laid-open Patent Publication Nos. 2-193152, 3-288157, and 4-31870, and polyamide resins to which suitable additives are added so as to prevent changes in the electric resistance due to the environment, as disclosed in Japanese laid-open Patent Publications Nos. 2-59458, 3-150572 and 2-53070, for example. Also, in Japanese laid-open Patent Publication Nos. 3-145652, 3-81778 and 2-281252 and others, it is proposed to mix a polyamide resin with other resin so as to control the electric resistance of the intermediate layer, and reduce or eliminate influences of the environment. It is, however, difficult for any of the materials disclosed in these publications to sufficiently suppress the influences of the temperature and humidity of the ambient environment, since these materials mainly use a polyamide-based resin having a high water absorbing property.

Other than the above-indicated materials, the intermediate layer of the photoconductor may also be formed, using cellulose derivatives (as disclosed in Japanese laid-open Patent Publication No. 2-238459), or polyether urethane (as disclosed in Japanese laid-open Patent Publication Nos. 2-115858, 2-280170), or polyvinyl pyrrolidone (as disclosed in Japanese laid-open Patent Publication No. 2-105349), or polyglycol ether (as disclosed in Japanese laid-open Patent Publication No. 2-79859). Although the use of these materials is effective when the resin layer has an extremely small thickness, the resistance of the intermediate layer is noticeably increased when it forms a relatively thick film having a thickness of several microns (μm) or larger, thereby causing an increase in the residual potential.

Where the intermediate layer as described above is used for a laser beam printer, there is a need to prevent deterioration of images due to interference fringes that tend to be caused depending upon the refractive index and film thickness of the photosensitive layer, and the wavelength of its light source. For this purpose, it has been proposed to add an inorganic pigment filler in general. For instance, it has been proposed to add fine grains of aluminum oxide (as disclosed in Japanese laid-open Patent Publication No. 3-24558), or mix a large amount of rutile-type titanium dioxide into acrylic melamine (as disclosed in Japanese laid-open Patent Publication No. 2-67565). To improve the dispersibility and electric characteristic of the filler, the intermediate layer having a thickness of 2 to 10 μm may be provided using an anatase-type titanium dioxide of 99% or higher purity, as the anatase-type titanium dioxide is more preferable than the rutile-type titanium dioxide in terms of the dispersibility and low resistance, as disclosed in Japanese laid-open Patent Publication No. 4-172361.

SUMMARY OF THE INVENTION

In the light of the above situations, it is an object of the present invention to provide an electrophotographic photoconductor or photosensitive member having an improved intermediate layer, which is free from an increase in the residual potential, and shows only small variations in the electric resistance upon environmental changes, thus assuring stable electric characteristics and high image quality in repetitive use.

To accomplish the above object, there is provided according to the present invention an electophotographic photoconductor comprising a conductive substrate, an intermediate layer formed on the conductive substrate and comprising a conductive boron polymer, and a photosensitive layer formed on the intermediate layer.

In the photoconductor of the present invention, the intermediate layer may advantageously contain a resin binder and an inorganic pigment.

The intermediate layer using the boron polymer shows electron-conduction-type semiconducting characteristics, and is therefore able to easily move electrons produced in the photosensitive layer during an electrophotographic process toward the substrate. Further, since electron conduction in the invented intermediate layer does not of an ion-conduction type due to absorbed moisture, its electric resistance does not vary with changes in the ambient environment.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENT

Figure 1:
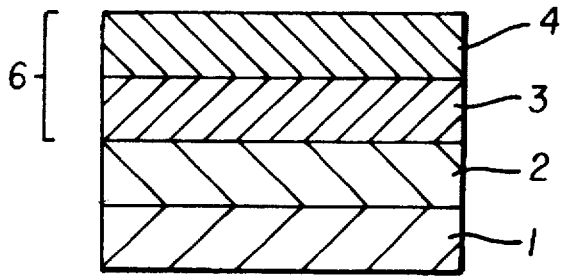
FIG. 1 is a cross sectional view showing a negatively charged, function-separated type electrophotographic photoconductor constructed according to one embodiment of the present invention.
Figure 2:
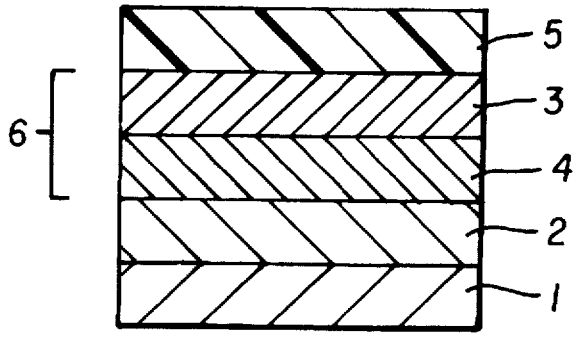
FIG. 2 is a cross sectional view showing a positively charged, function-separated type electrophotographic photoconductor constructed according to another embodiment of the present invention.
Figure 3:
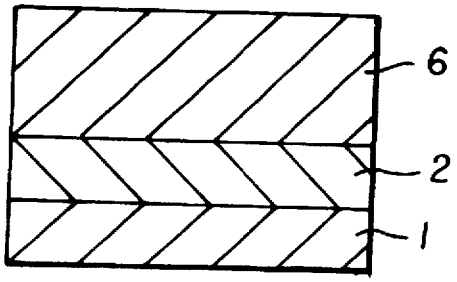
FIG. 3 is a cross sectional view showing a positively charged, single-layered type electrophotographic photoconductor constructed according to a further embodiment of the present invention.

The photoconductor of the present invention is constructed such that an intermediate layer and a photosensitive layer are successively laminated in this order on a conductive substrate. The photosensitive layer may be a single layer, or may be of a laminated type in which a charge generation layer and a charge transport layer having different functions are laminated on each other.

Reference numeral 1 denotes a conductive substrate, 2 is an intermediate layer, 3 is a charge generation layer, 4 is a charge transport layer, 5 is a surface protective layer, and 6 is a photosensitive layer.

The conductive boron polymer used in the present invention may be easily dissolved in a hydrophilic solvent, such as water, organic solvent containing lower alcohol, ether, and ketone, and may also be dissolved in a chlorine-based solvent, such as methylene chloride and carbon tetrachloride, or a petroleum-based solvent, such as benzene, toluene, and kerosene. The boron polymer also has good compatibility with high molecular substances.

The conductive boron polymer used in the present invention is an organic boron high molecular compound. The organic boron high molecular compound is not limited to a specific structure, but preferred examples of this type of organic boron high molecular compound may include Hi-Boron CTN-131, CTP-200, NSC-31, MCB-300 and MCB-400 available from Boron International, Japan.

A resin binder may be added to the conductive boron polymer in order to improve the adhesive strength of the intermediate layer with the conductive substrate, or increase the resistance of the charge generation layer to the solvent of the intermediate layer when the charge generation layer is formed on the intermediate layer. A resin used as the resin binder may be selected from condensation resins, such as polyamide resin, polyester resin, polyurethane resin, polycarbonate resin, and epoxy resin, and curable resins, such as polyvinyl chloride resin, acrylic resin, polyvinyl ketal resin, phenol resin, urea resin, melamine resin, guanamine resin, and furan resin. The resin binder used in the present invention may be added in an amount of 0 to 10000 parts by weight with respect to 100 parts by weight of the conductive boron polymer component.

Since the intermediate layer contains the conductive boron polymer as indicated above, the residual potential does not increase with an increase in the film thickness of this layer. In view of the uniformity of the coated film during film-forming, however, the thickness of the intermediate layer is preferably controlled to be in the range of 0.1 to 30 μm.

Where the photoconductor including the intermediate layer is used in a laser beam printer, there is a need to avoid deterioration of images due to interference fringes that appear depending upon the refractive index and film thickness of the photosensitive layer and the wavelength of its light source. For this purpose, an inorganic pigment filler is generally preferably added to the intermediate layer. This pigment may be selected from titanium oxide, zinc oxide, alumina and silica, for example. Where the photoconductor is used in a laser printer that effects writing of images with coherent light, such as a laser beam, in particular, it is preferable to use a white pigment having a large refractive index so as to prevent occurrence of a moire pattern. In this case, the proportion of the inorganic pigment thus added and the resin component is preferably controlled such that 10 to 500 parts by weight, more preferably, 50 to 300 parts by weight, of the inorganic pigment is present with respect to 100 parts by weight of the resin component.

The inorganic pigment as described above may be dispersed in a dispersion medium, using a paint shaker, three roll mill, ball mill, attrition mill, or sander grinder, for example.

The intermediate layer obtained from the above-described combination preferably has a volume resistivity of $10^{10}$ Ω·cm or smaller, so that electrons produced in the charge generation layer are easily conducted to the conductive substrate through the intermediate layer.

A dilute solution of the composition obtained by combining the conductive boron polymer, binder and the inorganic pigment is applied by coating onto the conductive substrate, to form a film on the substrate. While various known methods, such as dipping method, doctor blade, bar coater, roll transfer method, and spraying method, may be used as the coating method, the dipping method is particularly preferable when the conductive substrate having a cylindrical shape is coated with the solution.

The conductive substrate of the photoconductor of the present invention may be formed of a known aluminum alloy, such as those of JIS 3003 system, JIS 5000 system and JIS 6000 system, or other metal. The conductive substrate may also be formed of a resin, film or paper, for example, which is given suitable conductivity.

The conductive substrate is processed or finished with a given dimensional accuracy, by subjecting the aluminum alloy to an extruding or drawing process, or forming resin by injection molding. The surface of the conductive substrate is then finished as needed to provide a suitable surface roughness, by cutting or other process, using a diamond cutting tool, for example. The cutting work may not be performed for a reduced manufacturing cost. Subsequently, the surface of the conductive substrate is cleaned so as to remove an oil or the like used in the cutting process, or drawing process, thereby to provide a clean substrate surface. In this cleaning process, a chlorine containing organic solvent, such as trichlorothelene or fleon, or an aqueous detergent, such as an alkalescent detergent, may be used.

In the photoconductor according to the present invention shown in FIG. 1, the charge generation layer is formed on the intermediate layer. While the material of the charge generation layer is not particularly limited provided it has a desired light-sensitivity to the wavelength of the light source, an organic pigment, such as phthalocyanine pigment, azo pigment, quinacridone pigment, indigo pigment, perylene pigment, polycyclic quinone pigment, anthanthrone pigment, or benzimidazole pigment may be used as the charge generation material. These organic pigments may be dispersed or dissolved for use, in various kinds of resin binders including polyester resin, polyvinyl acetate, polyester methacrylate resin, polycarbonate resin, polyvinyl butyral resin, and phenoxy resin. The proportion of the mixture is preferably controlled such that 30 to 500 parts by weight of the organic pigment is used with respect to 100 parts by weight of the resin binder. The thickness of the charge generation layer is preferably in the range of 0.15 to 0.6 μm.

To produce the charge transport layer, a solution is prepared by mixing an enamine-based (system) compound, a styryl-based compound, amine-based compound, butadiene-based compound, or other compound, with a resin having good compatibility with these compounds, such as polyester resin, polycarbonate resin, polyester methacrylate resin, and polystyrene resin, for example. The thus prepared solution is applied by coating to the charge generation layer to form a film having a thickness of 10 to 40 μm when dried. To this charge transport layer may be added an antioxidant, ultraviolet ray absorbent, and a leveling agent.

EXAMPLES

Example 1

An intermediate layer was formed on an aluminum conductive substrate having an outside diameter of 30 mm and a length of 255 mm, in the following manner. Initially, 1 part by weight of conductive boron polymer (Trade Name: Hi-Boron CTN-131 manufactured by Boron International), and 10 parts by weight of melamine resin (Trade Name: Uvan 2020 manufactured by Mitsui Toatsu Chemicals, Inc., Japan) were dissolved in a mixed liquid of 50 parts by weight of methanol and 50 parts by weight of methylene chloride, and 10 parts by weight of titanium oxide (Trade name: P-25 manufactured by Japan Aerosil, Japan) was added to this solution, to prepare a coating liquid. The coating liquid thus prepared was then applied by coating to the conductive substrate, and dried for 15 min. at 120° C., so as to form the intermediate layer having a thickness of 10 μm.

In the next step, 2 parts by weight of X-type phthalocyanine was mixed with 98 parts by weight of a solution in which polyvinyl butyral resin was dissolved in tetrahydrofuran THF, and the mixture was dispersed in a ball mill for 30 hours, and applied by dipping onto the intermediate layer as described above. The coating on the intermediate layer was then dried at 100° C. for 10 min. to provide a charge generation layer.

In the next step, 10 parts by weight of hydrazone compound (Trade name: CTC 191 manufactured by Anan Corporation, Japan) and 10 parts by weight of polycarbonate (Trade name: L-1225 manufactured by Teijin Chemicals, Ltd., Japan) were uniformly dissolved in 80 parts by weight of dichloromethane, and the resulting solution was applied by the same coating method to the charge generation layer. The coating on the charge generation layer was then dried at 100° C. for 30 min. to form a charge transport layer having a thickness of 20 μm. In this manner, a photoconductor (photosensitive member, electrophotographic element) was produced.

Example 2

A photoconductor was prepared in the same manner as in Example 1, except that a different conductive boron polymer (Trade name: Hi-Boron CTN-200 manufactured by Boron International) was used, instead of the boron polymer used in Example 1.

Example 3

A photoconductor was prepared in the same manner as in Example 1, except that a different conductive boron polymer (Trade name: Hi-Boron NSC-31 manufactured by Boron International) was used, instead of the boron polymer used in Example 1.

Example 4

A photoconductor was prepared in the same manner as in Example 1, except that a different conductive boron polymer (Trade name: Hi-Boron MCB-300 manufactured by Boron International) was used, instead of the boron polymer used in Example 1.

Example 5

A photoconductor was prepared in the same manner as in Example 1, except that a different conductive boron polymer (Trade name: Hi-Boron MCB-400 manufactured by Boron International) was used, instead of the boron polymer used in Example 1.

Example 6

A photoconductor was prepared in the same manner as in Example 1, except that epoxy resin (Trade name: Araldite AER2662 manufactured by Asahi-Chiba, Japan) was used, instead of the melamine resin used in Example 1.

Example 7

A photoconductor was prepared in the same manner as in Example 2, except that epoxy resin (Trade name: Araldite AER 2662 manufactured by Asahi-Chiba) was used, instead of the melamine resin used in Example 2.

Example 8

A photoconductor was prepared in the same manner as in Example 3, except that epoxy resin (Trade name: Araldite AER 2662 manufactured by Asahi-Chiba) was used, instead of the melamine resin used in Example 3.

Example 9

A photoconductor was prepared in the same manner as in Example 4, except that epoxy resin (Trade name: Araldite AER 2662 manufactured by Asahi-Chiba) was used, instead of the melamine resin used in Example 4.

Example 10

A photoconductor was prepared in the same manner as in Example 5, except that epoxy resin (Trade name: Araldite AER 2662 manufactured by Asahi-Chiba) was used, instead of the melamine resin used in Example 5.

Comparative Example 1

A photoconductor was prepared in the same manner as in Example 1, except that the boron polymer as used in Example 1 was not used.

Comparative Example 2

A photoconductor was prepared in the same manner as in Example 6, except that the boron polymer as used in Example 6 was not used.

Each of the photoconductors produced in the manners as described above was installed on a laser beam printer, and printing tests were conducted in a normal environment of 25° C. and relative humidity of 50%, in a low-humidity, low-temperature environment of 10° C. and relative humidity of 20%, and in a high-humidity, high-temperature environment of 30° C. and relative humidity of 90%, respectively. The printing results in the initial period and printing results after 50,000 sheets were continuously printed in each of the above environments are shown in TABLE 1 through TABLE 3, where density of solid black portion means optical density reflected from a solid black portion of a test sample. The optical density D measured by a densitometer is defined by $D=\log_{10}(1/R)$, where R:reflectance. Printings are excellent when $D \geqq 1.40$.

TABLE 1

Printing Test Results at 25° C., 50% RH

| | Image obtained by Initial Printing | | Image after 50,000 sheet Printing | |
|---|---|---|---|---|
| | Black dots on white paper | Density of solid black portion | Black dots on white paper | Density of solid black portion |
| Example 1 | No occurrence | 1.42 | No occurrence | 1.42 |
| Example 2 | No occurrence | 1.42 | No occurrence | 1.41 |
| Example 3 | No occurrence | 1.41 | No occurrence | 1.40 |
| Example 4 | No occurrence | 1.42 | No occurrence | 1.42 |
| Example 5 | No occurrence | 1.42 | No occurrence | 1.41 |
| Example 6 | No occurrence | 1.43 | No occurrence | 1.42 |
| Example 7 | No occurrence | 1.42 | No occurrence | 1.42 |
| Example 8 | No occurrence | 1.41 | No occurrence | 1.40 |
| Example 9 | No occurrence | 1.42 | No occurrence | 1.41 |
| Example 10 | No occurrence | 1.40 | No occurrence | 1.42 |
| Comparative Example 1 | No occurrence | 1.31 | No occurrence | 1.14 |
| Comparative Example 2 | Very small dots occurred | 1.30 | Very small dots occurred | 1.22 |

TABLE 2

Printing Test Results at 10° C., 20% RH

| | Image obtained by Initial Printing | | Image after 50,000 sheet Printing | |
|---|---|---|---|---|
| | Black dots on white paper | Density of solid black portion | Black dots on white paper | Density of solid black portion |
| Example 1 | No occurrence | 1.42 | No occurrence | 1.38 |
| Example 2 | No occurrence | 1.41 | No occurrence | 1.39 |
| Example 3 | No occurrence | 1.39 | No occurrence | 1.40 |
| Example 4 | No occurrence | 1.41 | No occurrence | 1.39 |
| Example 5 | No occurrence | 1.39 | No occurrence | 1.39 |
| Example 6 | No occurrence | 1.40 | No occurrence | 1.40 |
| Example 7 | No occurrence | 1.41 | No occurrence | 1.41 |
| Example 8 | No occurrence | 1.39 | No occurrence | 1.39 |
| Example 9 | No occurrence | 1.39 | No occurrence | 1.41 |
| Example 10 | No occurrence | 1.41 | No occurrence | 1.40 |
| Comparative Example 1 | No occurrence | 1.19 | No occurrence | 1.11 |
| Comparative Example 2 | No occurrence | 1.23 | No occurrence | 1.17 |

TABLE 3

Printing Test Results at 30° C., 90% RH

| | Image obtained by Initial Printing | | Image after 50,000 sheet Printing | |
|---|---|---|---|---|
| | Black dots on white paper | Density of solid black portion | Black dots on white paper | Density of solid black portion |
| Example 1 | No occurrence | 1.40 | No occurrence | 1.39 |
| Example 2 | No occurrence | 1.40 | No occurrence | 1.41 |
| Example 3 | No occurrence | 1.41 | No occurrence | 1.39 |
| Example 4 | No occurrence | 1.39 | No occurrence | 1.40 |
| Example 5 | No occurrence | 1.41 | No occurrence | 1.41 |
| Example 6 | No occurrence | 1.40 | No occurrence | 1.38 |
| Example 7 | No occurrence | 1.41 | No occurrence | 1.39 |

TABLE 3-continued

| Printing Test Results at 30° C., 90% RH | | | | |
|---|---|---|---|---|
| | Image obtained by Initial Printing | | Image after 50,000 sheet Printing | |
| | Black dots on white paper | Density of solid black portion | Black dots on white paper | Density of solid black portion |
| Example 8 | No occurrence | 1.40 | No occurrence | 1.38 |
| Example 9 | No occurrence | 1.39 | No occurrence | 1.38 |
| Example 10 | No occurrence | 1.39 | No occurrence | 1.39 |
| Comparative Example 1 | Fog occurred | 1.22 | Fog occurred | 1.28 |
| Comparative Example 2 | Fog occurred | 1.31 | Fog occurred | 1.32 |

It will be understood from the above results that the photoconductors of Examples 1–10 produced high-quality images without suffering from occurrence of black dots and reduction of the printing density in any of the low-temperature, low-humidity environment, normal-temperature, normal-humidity environment, and high-temperature, high-humidity environment, and image defects did not occur even when the photoconductors were repeatedly used.

With the conductive boron polymer used in the intermediate layer according to the present invention, electric charges generating in the charge generation layer are easily moved into the conductive substrate, due to the semiconductive property of the conductive boron polymer, with a result of no increase in the residual potential, thereby to provide an electrophotographic photoconductor which assures a stable printing density. Further, since the conductive boron polymer has good environmental stability, the electric resistance of the intermediate layer using the conductive boron polymer does not vary with changes in the ambient environment, unlike an intermediate layer of an ionic conduction type, whereby the resulting electrophotographic photoconductor can stably produce high-quality images that are free from fogs and black dots.

What is claimed is:

1. An electrophotographic photoconductor comprising;

a conductive substrate;

an intermediate layer formed on said conductive substrate; and a photosensitive layer formed on said intermediate layer, wherein said intermediate layer comprises a conductive boron polymer.

2. An electrophotographic photoconductor according to claim 1, wherein said intermediate layer further contains a resin binding agent.

3. An electrophotographic photoconductor according to claim 1, wherein said intermediate layer further contains an inorganic pigment.

* * * * *